US005803366A

United States Patent [19]

Musso

[11] Patent Number: 5,803,366

[45] Date of Patent: Sep. 8, 1998

[54] MULTI-PORT DISTRIBUTION AXLE

[76] Inventor: Anthony J. Musso, 300 Norwood Ave., Bessemer, Ala. 35020

[21] Appl. No.: 734,928

[22] Filed: Oct. 22, 1996

[51] Int. Cl.[6] ..... B05B 3/06

[52] U.S. Cl. ..... 239/251; 239/289

[58] Field of Search ..... 239/225.1, 237, 239/243, 245, 246, 248, 249, 251, 261, 262, 263, 264, 265, 276, 279, 280.5, 581.1, 289; 446/15, 176

[56] References Cited

U.S. PATENT DOCUMENTS

| | | | |
|---|---|---|---|
| D. 194,920 | 4/1963 | Darling | 34/5 |
| 370,922 | 10/1887 | Best | 239/261 |
| 425,340 | 4/1890 | Oswald | 239/251 |
| 935,071 | 9/1909 | Vossler | 239/261 |
| 1,649,649 | 11/1927 | Bank | 239/280.5 X |
| 2,032,369 | 3/1936 | Kilpatrick | 239/251 X |
| 2,599,280 | 6/1952 | Phillips | 239/261 X |
| 2,727,266 | 12/1955 | Hagen | 239/251 X |
| 3,326,551 | 6/1967 | Clarke | 272/74 |
| 3,481,600 | 12/1969 | Lang | 272/74 |
| 3,744,721 | 7/1973 | Baumstark, Jr. | 239/264 X |
| 4,884,749 | 12/1989 | Ruprechter | 239/280.5 |

*Primary Examiner*—Andres Kashnikow
*Assistant Examiner*—Steven J. Gangy
*Attorney, Agent, or Firm*—Wm. Randall May

[57] ABSTRACT

A multi-ported axle hub and wheel assembly for directing and channeling liquids or dry chemicals under pressure from a single source to a plurality of outlet ports or spray nozzles rotating about the axis of the invention is disclosed. The apparatus can be used to direct and channel liquid or dry chemicals under pressure to, and to provide a source of rotation for, recreational devices such as water toys and for other non-recreational devices where liquid propulsion, liquid mixing or rotational spraying is desired.

4 Claims, 7 Drawing Sheets

MULTI-PORT DISTRIBUTION AXLE

BACKGROUND OF THE INVENTION

This invention relates generally to spraying devices and more particularly to a device for directing the flow of liquid or dry chemicals under pressure to a plurality of rotatable outlet ports. The design and construction of the present invention allows the device to be useful in a variety of applications including recreational water toys and in other non-recreational applications for commercial, industrial or agricultural purposes where liquid mixing or rotational spraying is desired.

Applicant is aware of rotatable recreational water devices such as those shown and disclosed in U.S. Patents to Lang, et al. (U.S. Pat. No. 3,481,600), Clarke (U.S. Pat. No. 3,866,916) and Darling (U.S. Pat. No. Des. 194,200) and that these devices, as such, are not new to the art. However, these devices are supplied and powered by and from a single non-rotatable port or source point and the liquid used with the devices must first completely fill the chambers or conduits of the devices in order for the devices to be operational. The weight of the liquid which must be carried within the chambers and conduits of the devices significantly restricts the number, size and type of conduits which can be used with the devices and greatly reduces the rotational efficiency of the devices. Devices used for commercial, industrial or agricultural purposes where rotational spraying or mixing is desired have similar problems with fluid or chemical weight and rotational efficiency.

The present invention provides the rotational efficiency and diversity missing in the prior art and provides a device which is useful in many different applications and for a variety of effects.

SUMMARY OF THE INVENTION

In view of the foregoing, it is a primary object of this invention to provide a multi-ported axle hub and wheel for directing and channeling liquid or dry chemicals under pressure from a single source to a plurality of outlet ports or spray nozzles rotating about the axis of the invention.

According to an embodiment of the invention, a multi-port axle assembly comprises a hub means having an attachment wheel and plurality of outlet ports; a support assembly; and a rotatable source coupling means.

An objective of the present invention is to provide apparatus for supplying liquid or dry chemicals under pressure to rotating devices wherein a plurality of supply points are desired.

Another objective of the present invention is to provide a convenient and efficient apparatus for rotatably directing and channeling liquid under pressure to, and to provide a source of rotation for, recreational devices such as water hoops, water "May Poles", hand held water toys, and other recreational devices where rotational dispersion or spraying of water or mist is desired.

Another objective of the present invention is to provide a convenient and efficient apparatus for rotatably directing and channeling liquid or dry chemicals under pressure to, and to provide a source of rotation for, household, commercial, industrial and/or agricultural devices where liquid propulsion, liquid mixing or rotational spraying is desired.

An important advantage of the present invention resides in the multi-port hub assembly which allows liquid or dry chemicals to be directed or channeled directly to one or more specific propulsion points for rotation and/or directly to any number of spray nozzles on an attached device thereby significantly reducing the volume of liquid or dry chemicals necessary to accomplish the objective or task of the attached device.

Another important advantage of the multi-port hub assembly of the present invention its ability to provide a source of power and/or spray to a plurality of propulsion outlets or spray nozzles rotating about the device.

A further advantage of the present invention resides in the adaptability of the device to a myriad of uses within the recreational, domestic, commercial, industrial and agricultural industries where liquid propulsion, liquid mixing or rotational spraying of liquids or dry chemicals is desired.

Another advantage of the present invention is the ability of the device to rotate and supply liquids or dry chemicals under pressure to a plurality of rotating points with great efficiency and economy.

Finally, the invention is particularly advantageous in that its unique features allow the device to be used with optional sources of rotation such as the force of the liquid flowing through the device, external forces such as motors or engines, or a combination of such sources.

BRIEF DESCRIPTION OF THE DRAWINGS

The foregoing and other objects, features, and advantages of the present invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
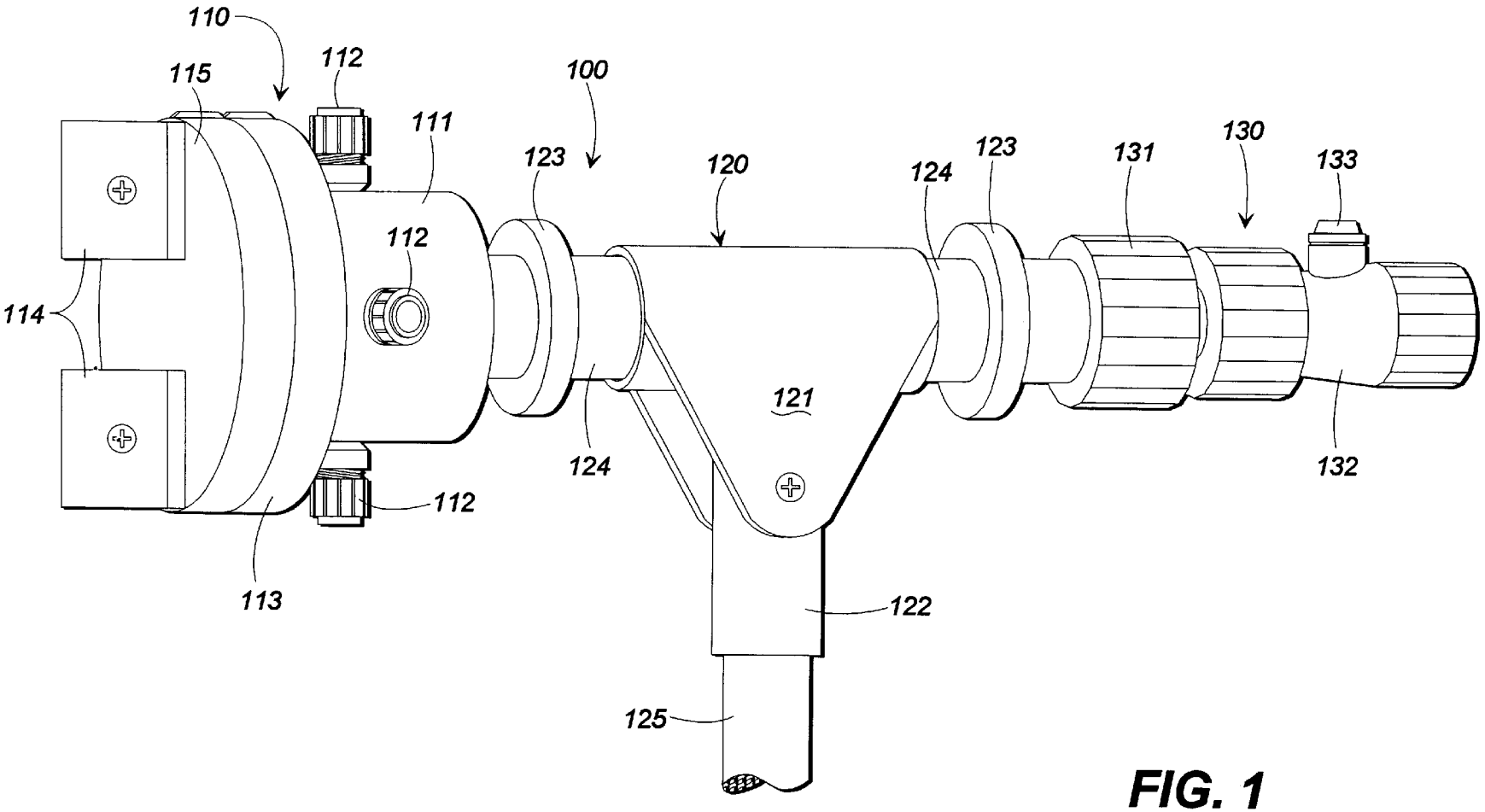
FIG. 1 is a perspective view of an embodiment of the invention.

In accordance with an embodiment of the invention, FIG. 1 shows a multi-port axle assembly 100 having a hub means 110, a support assembly 120 and a coupling assembly 130.

Figure 3:
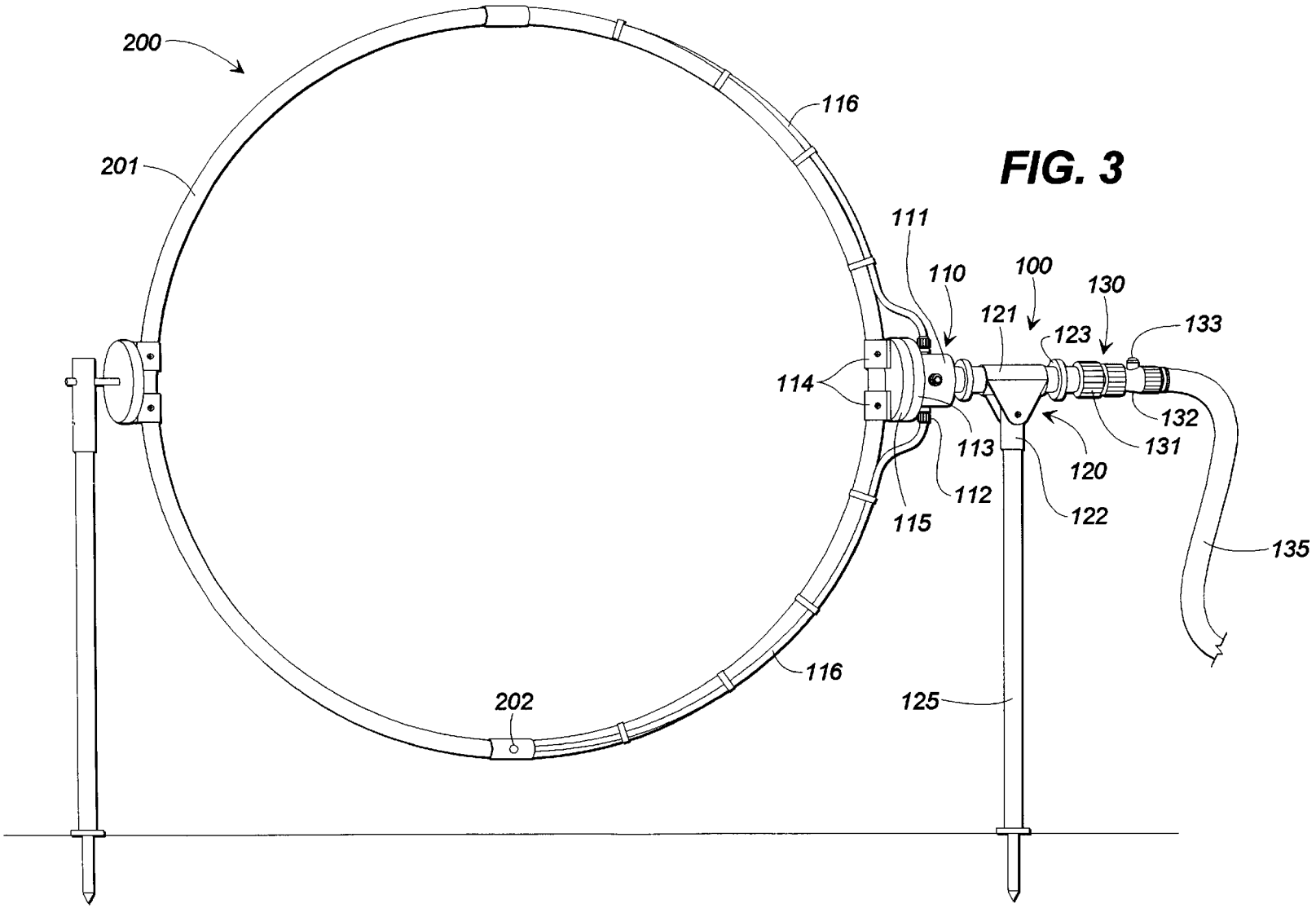
FIG. 3 is a perspective view of the embodiment of FIG. 1 showing the invention being used with a rotatable water hoop toy.
Figure 4:
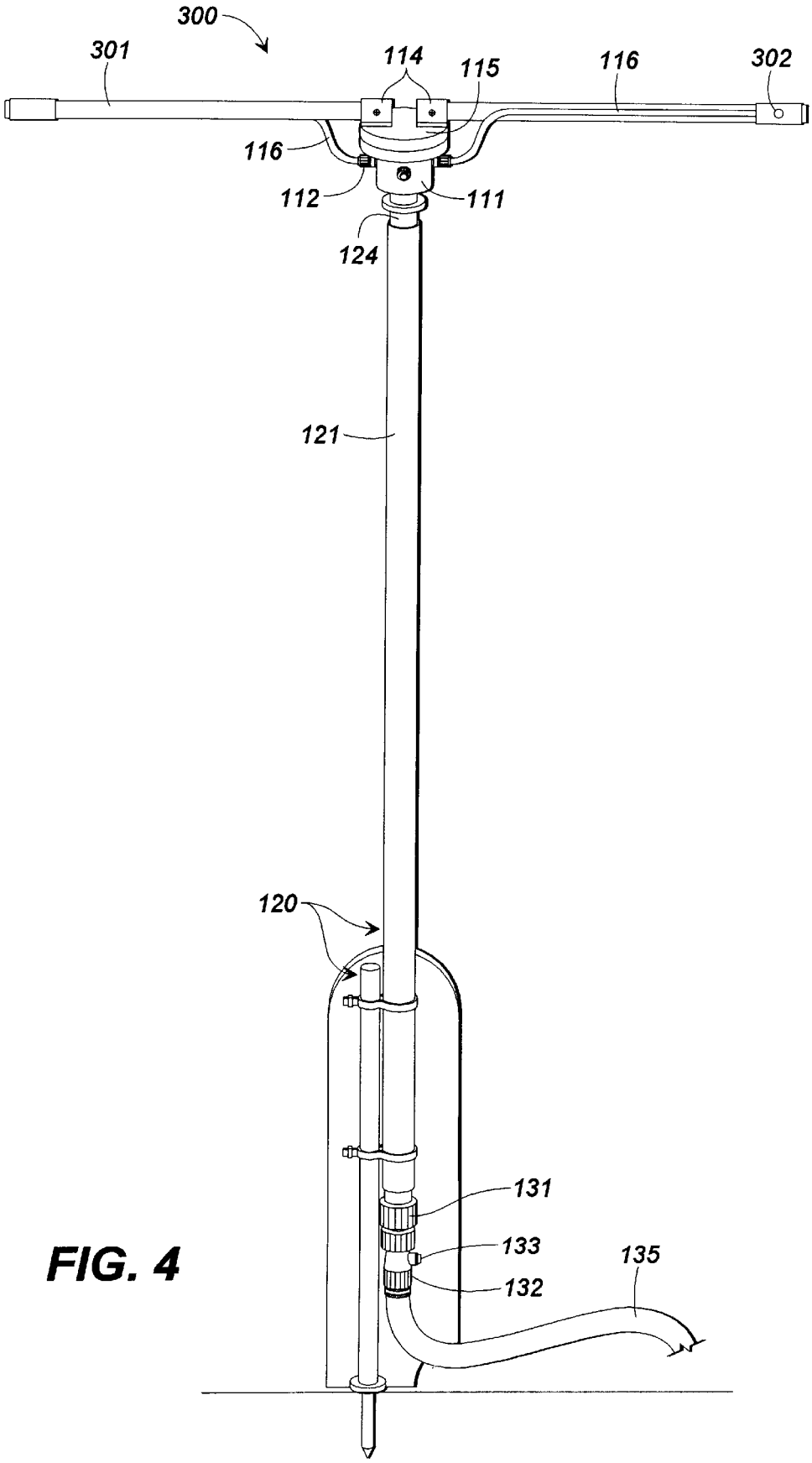
FIG. 4 is a perspective view of the embodiment of FIG. 1 showing the invention being used with a rotating pole-mounted water toy.

The hub means 110 comprises a hub member 111 having a plurality of outlet ports 112 and an attachment wheel 113. A mounting pad 115 is rigidly attached adjacent to the attachment wheel 113 and serves to secure rotating members such as tubes, rods, paddles or cables to said attachment wheel 113. The present embodiment of FIG. 1 shows mounting members 114 attached to said mounting pad 115. Said mounting members 114 can be used to secure rigid or semi-rigid tubing members 201/301 to said attachment wheel 113 as shown in FIGS. 3 & 4. Flexible tubing members 116, as shown in FIGS. 3–7, may be attached to one or more outlet ports 112 of said hub member 110 for supplying propulsion fluid, spray fluid or dry chemicals to a variety of rotatable mechanisms.

Figure 2:
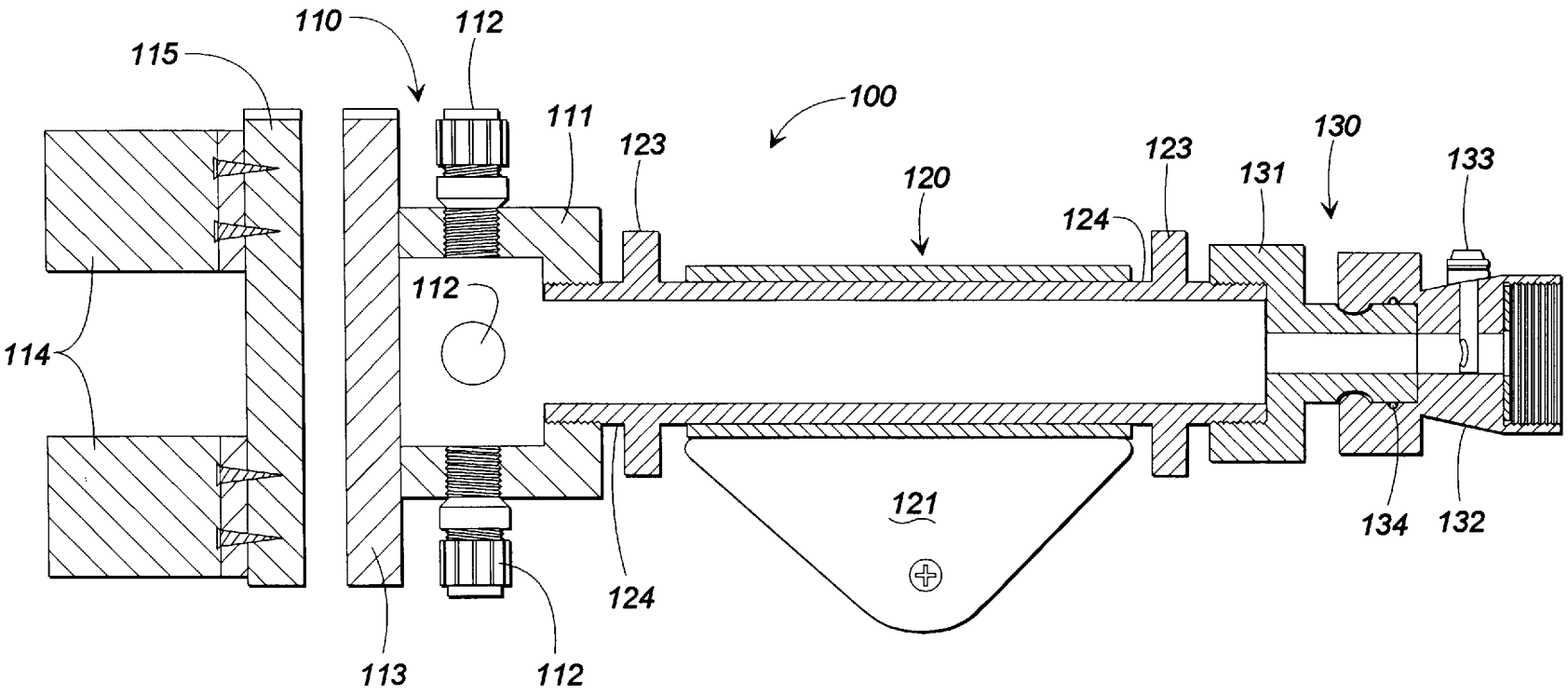
FIG. 2 is a sectioned side view of the embodiment of FIG. 1.

As best seen in FIG. 2, the support assembly 120 comprises a support sleeve 121, a supply nipple 124 threaded externally at each end, and a pair of pivot washers 123. Said supply nipple 124 is the conduit for supplying fluid or dry chemicals under pressure to the hub means 110 and is threadably attached to said hub means 110 at one end. The support sleeve 121, as shown in the embodiments of FIGS. 1, 2 and 3, is pivotally attached to a mounting support 122. Said mounting support 122 is shown slidably mounted to a support rod 125 which may be anchored to the ground or other supporting medium depending on the particular application of the invention.

The coupling assembly 130 comprises an adapter 131 for threadably receiving one end of said supply nipple 124 and for releaseable and rotatable connection with a coupling member 132. As shown in FIG. 2, said coupling member 132 is a typical "quick connector" mechanism which allows the coupling member 132 to be quickly and easily connected or disconnected from said adapter 131. The coupling member 132 is provided with an "o" ring seal 134 to insure the mechanism is water tight when connected to said adapter 131. Said coupling member 132 is also provided with a shut off valve 133 and is threaded internally at one end for receiving a liquid supply line such as a water hose 135 as shown in embodiments of FIGS. 3, 4, 5 and 7.

In use, a pressurized liquid or dry chemical is allowed to flow into the rotatable coupling means 130, through the supply nipple 124 and into the hub means 110 where the liquid or dry chemical is then channeled through one or more outlet ports 112 as desired or needed for the particular application. As shown in the figures, the liquid or dry chemical channeled through said hub means 110 may be further channeled through flexible tubing members 116 attached at said outlet ports 112 to a variety of rotatable mechanisms. The rotatable mechanisms can also be secured to the attachment wheel 113 of the invention in a variety of ways as shown. Some rotatable mechanisms can be caused to rotate by the expulsion of liquid or dry chemical supplied to said mechanism through the flexible tubing members 116 of said hub means 110. The hub member 111, the supply nipple 124 and the adapter 131 of the multi-port axle assembly 100 are designed to freely rotate with said rotating mechanism.

As previously stated, the present invention can be used or is useful with a variety of mechanisms where liquid propulsion, rotational spraying or liquid mixing is desired. In one example, FIG. 3 shows a water hoop toy 200 having a semi-rigid hoop-shaped tubular member 201 which is attached on one side to the mounting pad 115 of the present invention via the tubular mounting members 114 as previously discussed. In this embodiment, only two flexible tubing members 116 are needed to provide the propulsion and spray necessary to rotate and enjoy the hoop toy 200. The flexible tubing members 116 are extended in opposite directions from the hub member 111 along the tubular member 201 to opposing propulsion ports 202 located on the vertical axis of said tubular member 201 as shown. Liquid from said propulsion ports 202 may also be directed or sprayed toward the center of the hoop 200 for additional enjoyment.

In another example, FIG. 4 shows a "May Pole" type water toy 300 having a pair of rigid tubular members 301 which are attached at one end to the mounting pad 115 of the present invention via said tubular mounting members 114 and extend laterally and horizontally away from said mounting pad 115 as shown. Again, in this embodiment only two flexible tubing members 116 are needed to provide the propulsion and spray necessary to rotate and enjoy the recreational device 300. Here again, the flexible tubing members 116 are extended in opposite directions from the hub member 111 along each tubular member 301 to opposing propulsion ports 302 located at each end of said tubular member 301. The support sleeve 121 and supply nipple 124 of this embodiment are elongated in order to obtain the proper height necessary to use and enjoy the recreational device 300. As in the previous example, liquid from said propulsion ports 302 may also be directed or sprayed downward for additional enjoyment.

Figure 5:
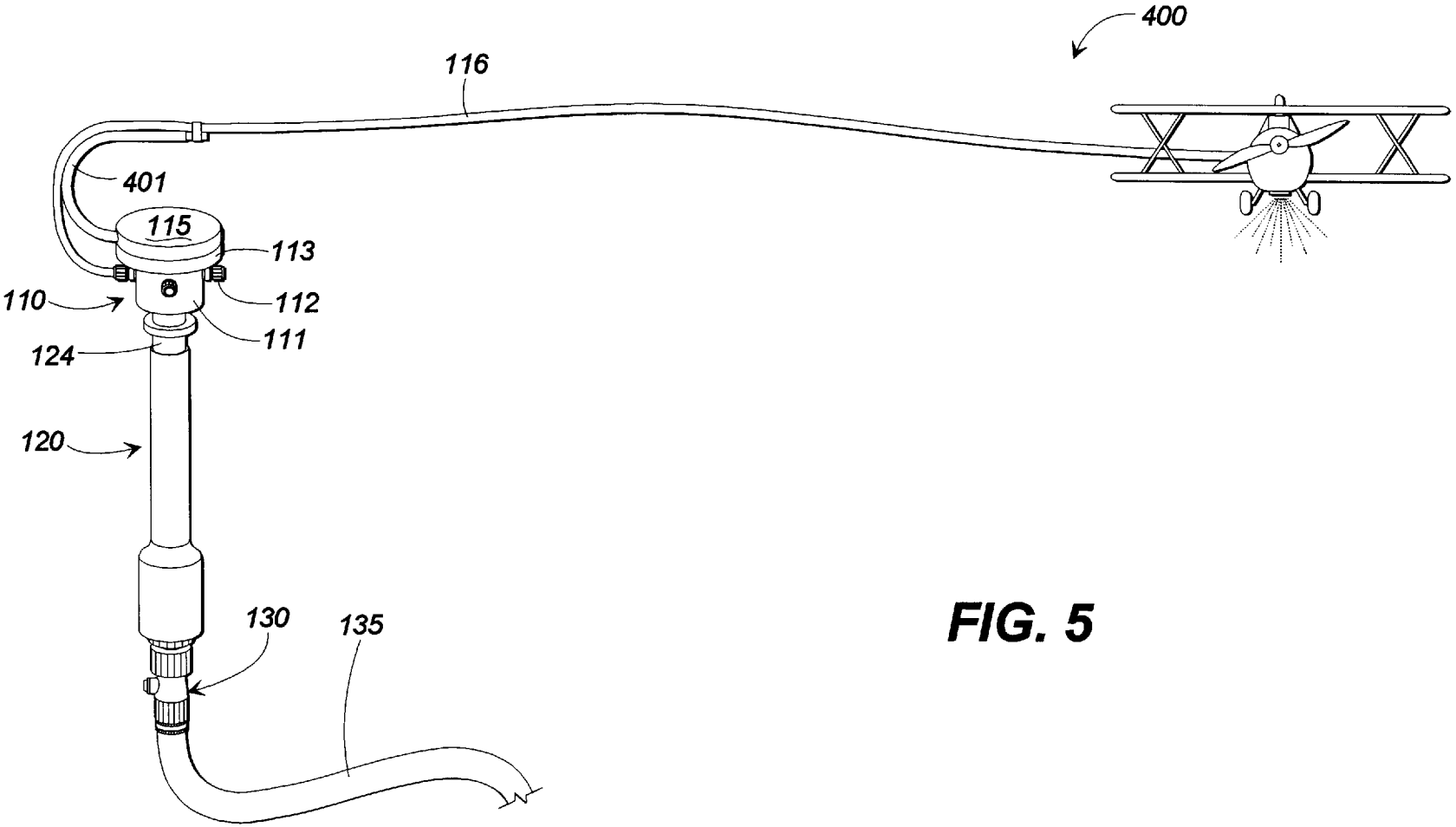
FIG. 5 is a perspective view of the embodiment of FIG. 1 showing the invention being used with a rotating hand-held water toy.

FIG. 5 shows an embodiment of the present invention being used with a hand-held water toy 400. In this embodiment the water toy 400 is rotated by hand or other mechanical means and only one flexible tubing member 116 is needed to provide the spray necessary to enjoy the water toy 400. The flexible tubing member 116 is attached to and supported by a flexible support member 401. Said flexible support member 401 is securely attached to the mounting pad 115 at a point along the outer edge of said mounting pad 115 corresponding to the location of the outlet port 112 of said flexible tubing member 116.

Figure 6:
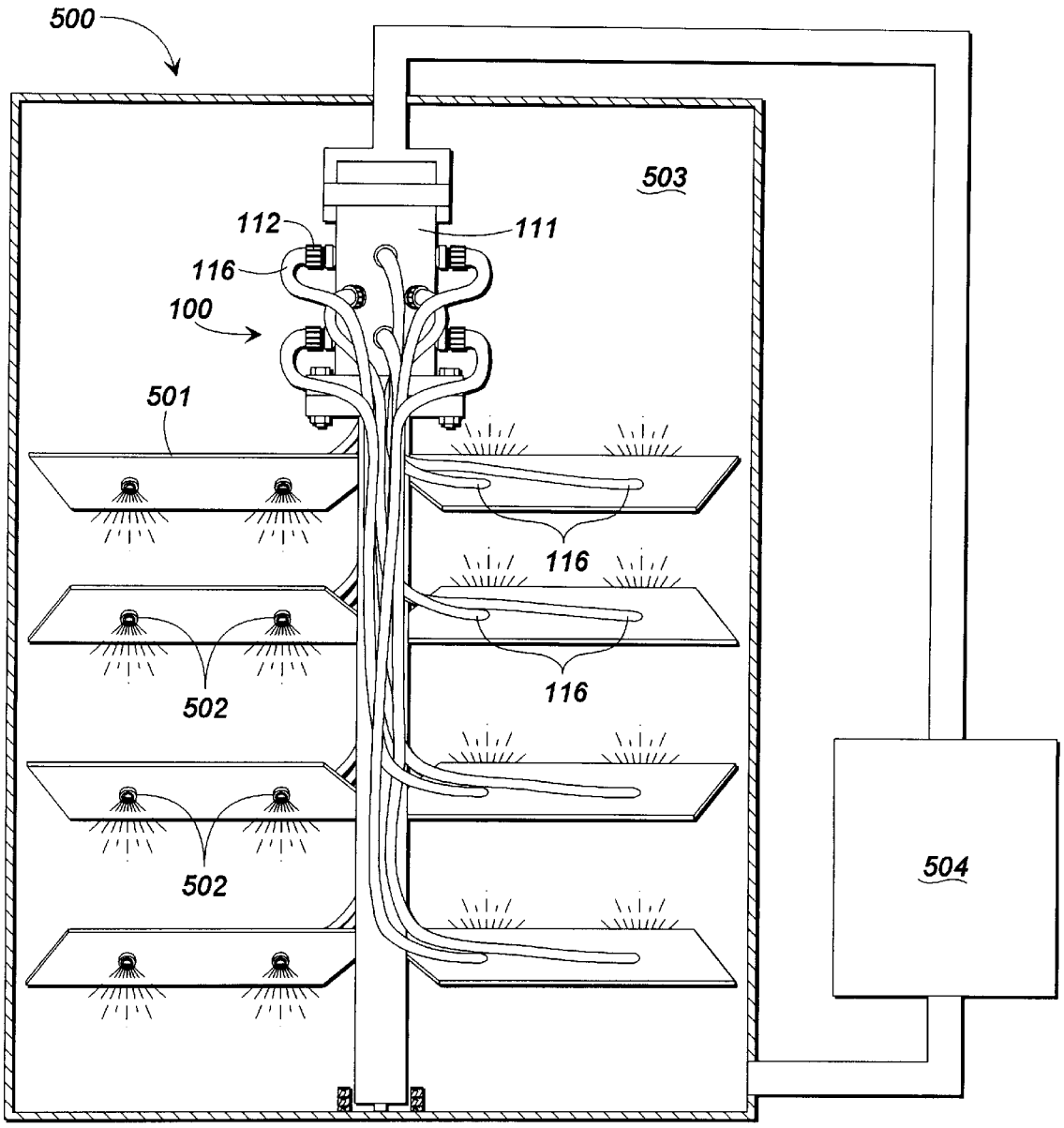
FIG. 6 is a plan view, partially sectioned, of the embodiment of FIG. 1 showing the invention being used with a mixing machine.

FIG. 6 shows an embodiment of the present invention being used with a liquid mixing device 500. In this embodiment, a plurality of flexible tubing members 116 are needed to provide the propulsion necessary to rotate paddles 501 within a mixing chamber 503. In this example, the liquid being mixed is pumped from the bottom of the mixing chamber 503 via a pumping mechanism 504 to the multi-port axle assembly 100. A pair of propulsion nozzles 502 supplied by flexible tubing members 116 are located on each opposing mixing paddle 501 as shown and provide the rotational propulsion for the mixing device 500. In this embodiment of the present invention, the hub member 111 is elongated in order to accommodate the number of outlet ports 112 and flexible tubing members 116 necessary for proper operation of the mixing device 500.

Figure 7:
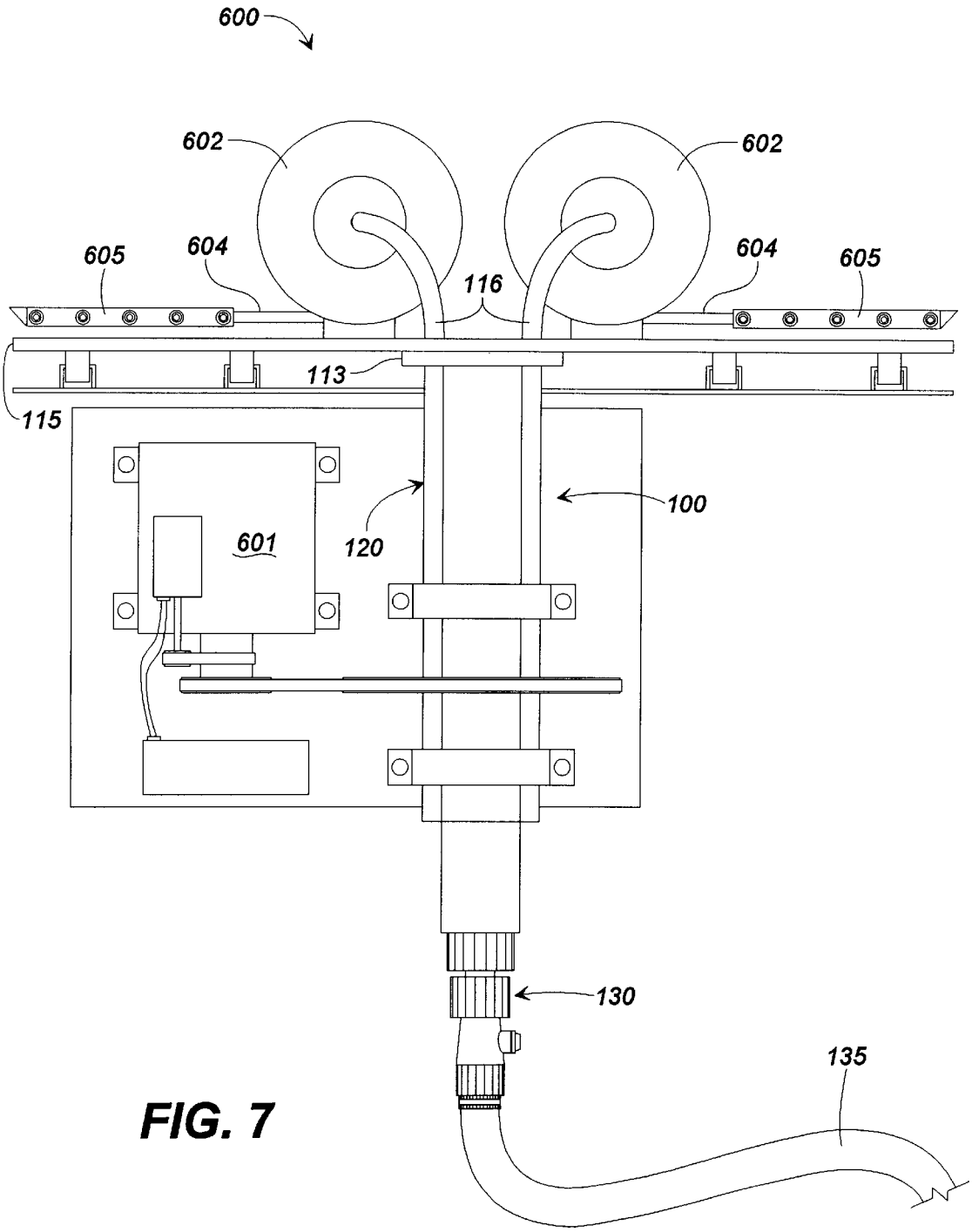
FIG. 7 is a side view of the embodiment of FIG. 1 showing the invention being used with a motorized agricultural sprayer.

FIG. 7 shows an embodiment of the present invention being used with a motorized rotating agricultural sprayer 600. In this embodiment, the multi-port axle assembly 100 is rotated by a motor means 601. A pair of appropriately sized flexible tubing members 116 extend from the hub means 110 and are attached to hose reels 602 comprising extendable hose members 604 to which are attached spray nozzles 605. As the axle assembly 100 is rotated by the motor means 601, the hose members 604 supplied by the flexible tubing members 116 are caused to extend laterally from said hose reels 602 for spraying a circular area of crops or fields.

While the invention has been particularly shown and described with reference to the preferred embodiments thereof, it will be understood by those skilled in the art that various alterations in form, detail and construction may be made therein without departing from the spirit and scope of the invention.

The embodiments of the invention in which an exclusive property right or privilege is claimed are defined as follows:

1. A multi-port axle assembly for directing and channeling liquids or dry chemicals under pressure from a single source to a plurality of outlet ports or spray nozzles rotating about the axis of the assembly comprising:

a hub means comprising:

a hub member having, a wheel means and, flexible tubing members attached to one or more of said outlet ports for supplying propulsion fluid and/or spray to a variety of rotatable mechanisms attached to said hub means;

a support assembly attached to said hub means comprising:

a support sleeve for receiving and slidably supporting, a rotatable supply nipple; and, a rotatable coupling assembly attached to said support assembly comprising:

an adapter for receiving one end of said rotatable supply nipple and, a coupling member for releasable and rotatable leak-tight pressure connection with said adapter and for connection with a liquid or dry chemical supply means.

2. The apparatus of claim 1, wherein said wheel means further comprises a mounting pad rigidly attached to said wheel means having mounting members used to secure rigid or semi-rigid tubing members to said wheel means for rotatable attachment of liquid propulsion or spray mechanisms.

3. The apparatus of claim 1, wherein said support assembly is positioned on the rotating side of said coupling assembly.

4. The apparatus of claim 1, wherein a power source for rotation of said outlet ports or spray nozzles is derived from the pressurized liquids or dry chemicals being channeled through said axle assembly.

* * * * *